US006321958B1

(12) United States Patent
Erdmann

(10) Patent No.: US 6,321,958 B1
(45) Date of Patent: Nov. 27, 2001

(54) CLIP-ON PACKET

(76) Inventor: Christine Erdmann, 7200 Franklin Ave., Los Angeles, CA (US) 90046

( * ) Notice: Subject to any disclaimer, the term of this patent is extended or adjusted under 35 U.S.C. 154(b) by 0 days.

(21) Appl. No.: 09/518,522

(22) Filed: Mar. 4, 2000

(51) Int. Cl.[7] ..... A45F 5/00

(52) U.S. Cl. ..... 224/236; 224/251; 224/269; 224/682; 224/901.6

(58) Field of Search ..... 224/649, 652, 224/236, 251, 269, 901.6, 680, 681, 682

(56) References Cited

U.S. PATENT DOCUMENTS

| | | | | |
|---|---|---|---|---|
| D. 266,202 | | 9/1982 | Berman . | |
| D. 323,744 | | 2/1992 | Casale . | |
| D. 410,331 | | 6/1999 | Hamilton . | |
| 1,648,565 | | 11/1927 | Primley . | |
| 3,148,812 | * | 9/1964 | Hilsinger, Jr. | 224/250 |
| 4,174,793 | * | 11/1979 | Wisowaty | 224/240 |
| 4,214,686 | * | 7/1980 | Dostourian | 150/134 |
| 4,356,943 | | 11/1982 | Berman . | |
| 5,103,884 | * | 4/1992 | Roman | 150/134 |
| 5,392,974 | * | 2/1995 | Johnson-Rabbett | 224/253 |
| 5,533,656 | * | 7/1996 | Bonaldi | 224/667 |
| 5,964,386 | * | 10/1999 | Cote | 224/250 |

* cited by examiner

*Primary Examiner*—Stephen K. Cronin
(74) *Attorney, Agent, or Firm*—Goldstein Law Offices, P.C.

(57) ABSTRACT

A clip-on pocket, for securing over a horizontal garment surface, comprising a main portion having a main portion top, a main portion bottom, and main portion sides. The main portion comprises a front panel and a rear panel. The front panel is stitched to the rear panel along the main portion sides and main portion bottom, defining a main compartment which is sized to hold credit-card size items and is accessible at the main portion top. A main flap extends over the main portion top and secures onto the front panel, maintaining objects in the main compartment safely therein. A storage sleeve extends horizontally along the main portion bottom, and allows storage of a cylindrical object, such as a lipstick canister. A clip is attached to main portion at the rear panel, and allows the pocket to be attached over the horizontal garment surface.

4 Claims, 2 Drawing Sheets

CLIP-ON PACKET

BACKGROUND OF THE INVENTION

The invention relates to a clip-on pocket. More particularly, the invention relates to a pocket which may be clipped onto a garment of a user, to provide additional storage of personal items.

Although it can feel liberating to "travel light" when away from home, typically one must carry at least a few personal items. In particular, most people feel more comfortable when they at least carry identification, a credit card, and some currency.

Most of these personal items are easily carried in one's pockets. However, not all garments have pockets. In particular, many women's garments lack pockets. Dresses, skirts, and many types of women's pants have no pockets whatsoever. Accordingly, many women carry a purse or pocketbook when wearing such garments. However, carrying a purse or pocketbook is not always desirable, in that the purse can interfere with an otherwise flawless look, and that the purse or pocketbook can simply be inconvenient to carry.

U.S. Pat. No. 4,356,943 and U.S. Pat. No. Des. 266,202 to Berman, both show belt mounted bags, which have a belt loop through which the user's belt is inserted to support the bag. However, these design configurations require that the user wear a belt, and that they choose to don the bag or purse at the time that the belt is put on. Accordingly, the devices proposed by Berman cannot be quickly and easily donned by the user, or removed therefrom.

U.S. Pat. No. Des. 323,744 to Casale shows a clip on purse which has a multitude of pockets and storage spaces. Accordingly, the device proposed by Casale is far from unobtrusive, and would interfere with the appearance of most outfits.

While these units may be suitable for the particular purpose employed, or for general use, they would not be as suitable for the purposes of the present invention as disclosed hereafter.

SUMMARY OF THE INVENTION

It is an object of the invention to produce a clip-on pocket which readily attaches onto the garment of a user. Accordingly, the pocket has a clip on its rear surface for attaching over a belt or over the rim of a pair of pants.

It is another object of the invention to provide a clip-on pocket which allows a few personal items to be Accordingly, the purse has a pocket which is conveniently sized for carrying identification, currency, credit cards, and the like, but is small enough so as to be relatively inconspicuous.

It is a further object of the invention to provide a clip-on pocket which provides additional storage for a lipstick canister. Accordingly, a horizontal sleeve is provided beneath the compartment which allows a lipstick canister to inserted and conveniently stored therein until removed by the user.

It is a still further object of the invention to provide a clip-on pocket which is attractive and fashionable so that it blends into a variety of different outfits. Accordingly, the clip-on pocket may be provided in classic black, or may be closely color coordinated to match the outfit with which it is worn.

The invention is a clip-on pocket, for securing over a horizontal garment surface, comprising a main portion having a main portion top, a main portion bottom, and main portion sides. The main portion comprises a front panel and a rear panel. The front panel is stitched to the rear panel along the main portion sides and main portion bottom, defining a main compartment which is sized to hold credit-card size items and is accessible at the main portion top. A main flap extends over the main portion top and secures onto the front panel, maintaining objects in the main compartment safely therein. A storage sleeve extends horizontally along the main portion bottom, and allows storage of a cylindrical object, such as a lipstick canister. A clip is attached to main portion at the rear panel, and allows the pocket to be attached over the horizontal garment surface.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
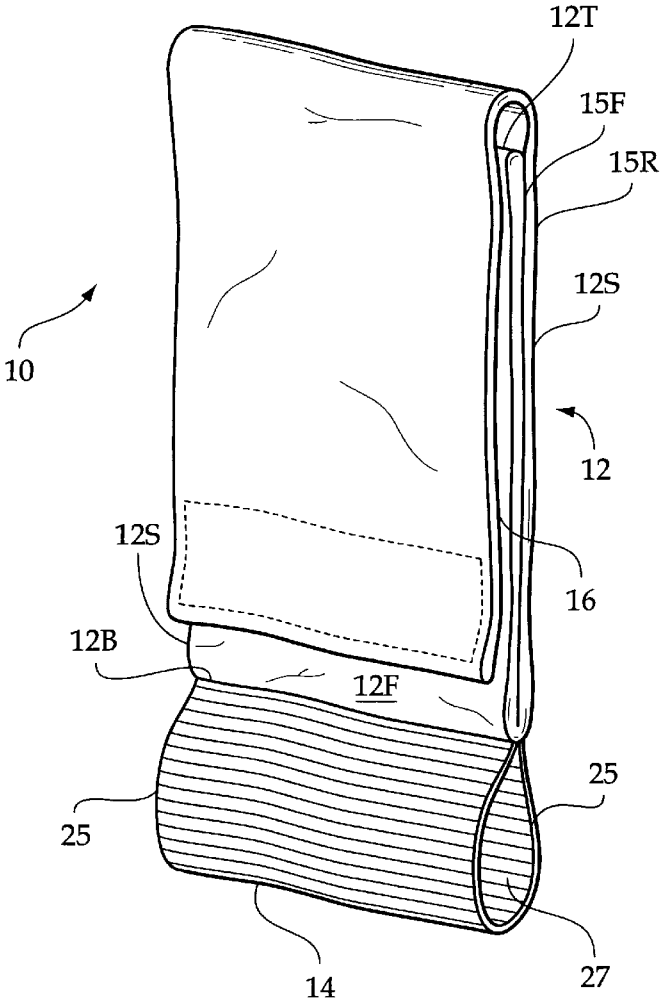
FIG. 1 is a diagrammatic perspective view illustrating the invention per se.

FIG. 1 illustrates a clip on pocket 10, having a main portion 12, having a main portion front 12F, a pair of main portion sides 12S, a main portion top 12T, and a main portion bottom 12B. The main portion 12 is comprised of a front panel 15F and a rear panel 15R. A storage sleeve 14 extends horizontally along the main portion bottom 12B. A main flap 16 extends from the rear panel 15R of the main portion 12 from the main portion top 10T, extends over the front panel 15F, and extends down the front panel 15F wherein the main flap 16 is fastened to the front panel 15F near the main portion bottom 12B. The front panel 15F is stitched to the rear panel 15R along the main portion sides 12S and along the main portion bottom 12B.

Figure 3:
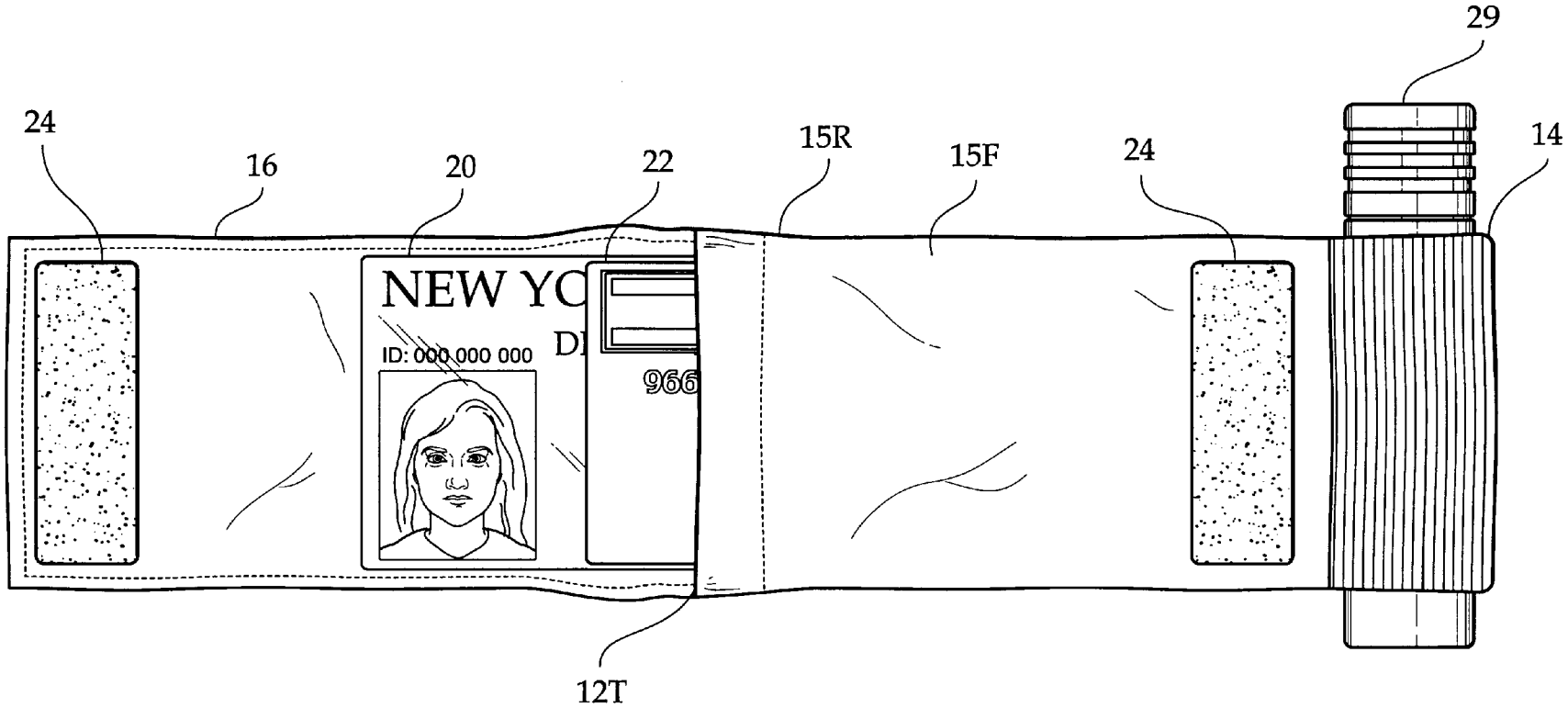
FIG. 3 is a front elevational view, with the main flap in the open position, so that personal items may be inserted into the main compartment, and showing a lipstick canister stored with the storage sleeve.

Referring momentarily to FIG. 3, the front panel 15F is not stitched to the rear panel 15R along the main portion top 12T so that a main compartment is defined between the front panel 15F and rear panel 15R. As seen in FIG. 3, personal items, such as identification 20, credit cards 22, or currency may be stored in said main compartment. Accordingly, the size of the compartment is selected so as to best accommodate credit-card sized items.

Also apparent in FIG. 1 and FIG. 3, the main flap 16 is preferably formed from a continuous piece of material with the rear panel 15R. Accordingly, the rear panel 15R preferably simply folds over, and continues down in front of the front panel 15F to form said main flap 16. Also seen in FIG. 3, hook and loop fastener material 24 is provided on both the front panel 15F and on the main flap 16 to allow said main flap 16 to be secured to the front panel 15F, to allow effective closure of the compartment, to maintain the personal items safely therein.

Referring again to FIG. 1, the storage sleeve 14 extends along the entire main portion bottom 12B, has two open ends 25, and a channel 27 extending therebetween. It is sized to accommodate a lipstick canister 29 as seen in FIG. 3, but can allow virtually any cylindrical object to be inserted into one of the open ends 25 and held firmly therein, until withdrawn by the user. The storage sleeve 14 is preferably made of an elastic fabric, so that it expands to accommodate the cylindrical object as it is inserted into the channel 27, will contract to squeeze the cylindrical object, and hold it within said channel 27. The cylindrical object is held horizontally in the channel until it is removed. The force necessary to remove the cylindrical object is minimal, but the elastic forces of the storage sleeve 14 are sufficient to keep the cylindrical object from falling out of said storage sleeve 14.

Figure 2:
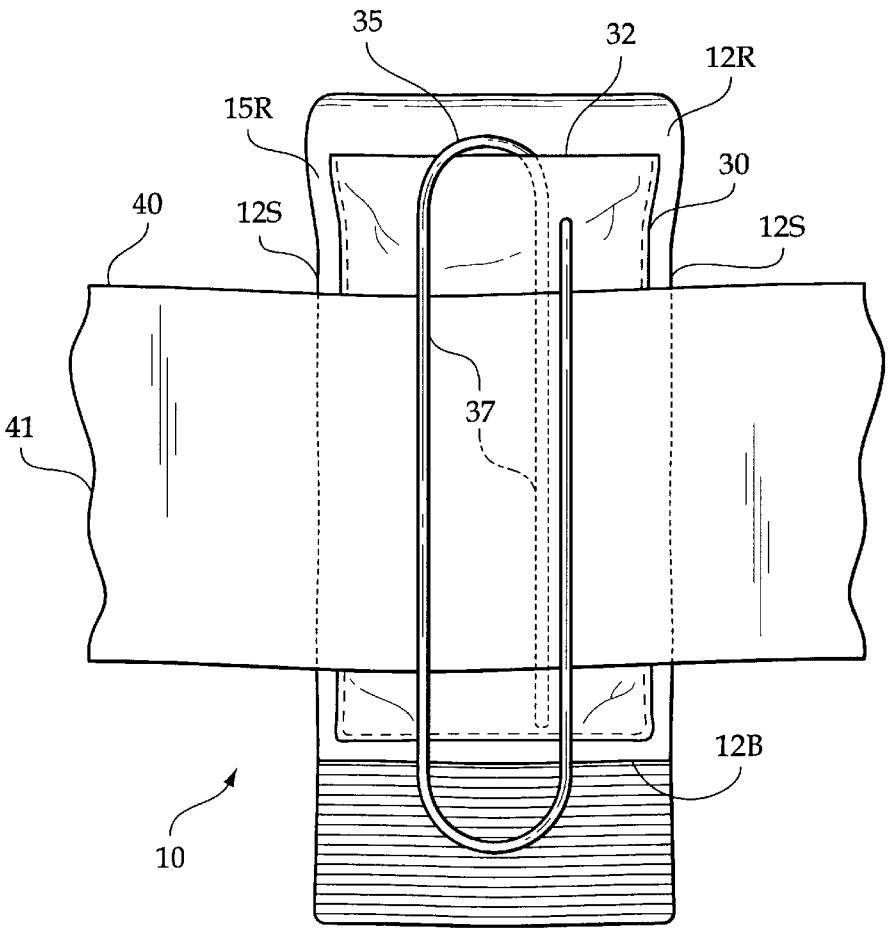
FIG. 2 is a rear elevational view, illustrating the invention in use, clipped onto a belt.

FIG. 2 is a rear elevational view of the clip-on pocket 10. The main portion 12 has a main portion rear 12R, which is formed essentially by the rear panel 15R. A secondary panel 30 is stitched to the rear panel 15R. The secondary panel 30 is stitched to the rear panel 15R substantially along the main portion sides 12S and the main portion bottom 12B, leaving a secondary panel opening 32 near the main portion top 12T. A double sided clip 35 has two prongs 37 One prong 37 extends downward through the secondary panel opening 32 between the secondary panel 30 and the rear panel 15R. The other prong 37 extends downward outside the secondary panel 30, so that that prong can clip over a horizontal garment surface 40 of a garment 41. The horizontal garment surface 40 may be a belt top, a waistband, or the like.

In conclusion, herein is presented a clip-on pocket, which allows a user to hold a few personal items, such as identification, credit cards, currency, and lipstick, which attaches onto a garment so that it is conveniently available and unobtrusive to the user. Accordingly, the invention is embodied in the form shown in the various drawing figures. Numerous variations are possible while maintaining the spirit of the invention. Such variations are contemplated as being part of the present invention.

What is claimed is:

1. A clip-on pocket, for securing over a horizontal garment surface and providing storage for personal items, comprising:

a main portion having a main portion top, a main portion bottom, a main portion rear, a main portion front, and a pair of main portion sides, the main portion front comprised of a front panel, the main portion rear comprised of a rear panel, the front panel stitched to the rear panel along the main portion sides and main portion bottom, defining a main compartment accessible through an opening at the main portion top, the main compartment sized to hold credit card size items snugly therein;

a secondary panel attached to the rear panel near the main portion sides and main portion bottom, having a secondary panel opening near the main portion top;

a main flap extending from the rear panel across the main portion top and downward in front of the front panel, the main flap securable to the front panel near the front panel bottom by hook and loop fasteners, the main flap preventing personal items in the main compartment from escaping therefrom at the main portion top;

a storage sleeve, made of elastic material, the storage sleeve attached to the main portion bottom, extending substantially fully along the main portion bottom, the storage sleeve having two open ends and a channel extending therebetween, the storage sleeve allowing a cylindrical object substantially the size of a lipstick canister to be inserted through one of the open ends and held firmly within the sleeve until removed therefrom; and a clip, having two prongs, one prong extending between the rear panel and the secondary panel, the other prong capable of extending over the horizontal garment surface for securing the main portion onto the garment.

2. A clip-on pocket, for securing over a horizontal garment surface and providing storage for personal items, comprising:

a main portion having a main portion top, defining a main compartment accessible through an opening at the main portion top, the main compartment sized to hold credit card sized items fit snugly therein, the main portion having a main portion bottom, a main portion rear, a main portion front, a pair of main portion sides, the main portion front comprised of a front panel, the main portion rear comprised of a rear panel, the front panel stitched to the rear panel along the main portion sides and main portion bottom;

a main flap securable to the front panel near the front panel bottom by hook and loop fasteners, the main flap extends from the rear panel across the main portion top and downward in front of the front panel, the main flap preventing personal items in the main compartment from escaping therefrom at the main portion top;

a storage sleeve, the storage sleeve attached to the main portion bottom and extending horizontally, for holding a cylindrical object firmly therein;

a secondary panel attached to the rear panel having a secondary panel opening near the main portion top; and a clip for securing the main portion over the horizontal garment surface of the garment, the clip has two prongs, one prong extending between the rear panel and the secondary panel, the other prong capable of extending over the horizontal garment surface for securing the main portion onto the garment.

3. The clip-on pocket as recited in claim 2, wherein the storage sleeve extends substantially fully along the main portion bottom, the storage sleeve having two open ends and a channel extending therebetween, the storage sleeve allowing a cylindrical object substantially the size of a lipstick cannister to be inserted through one of the open ends and held firmly within the sleeve until removed therefrom.

4. The clip-on pocket as recited in claim 3, wherein the main flap is secured to the main portion front by hook and loop fastener material present on both the main flap and the front panel.

* * * * *